United States Patent [19]

Knoll et al.

[11] 4,024,828

[45] May 24, 1977

[54] SIGNALING DEVICE

[75] Inventors: Frank Knoll, Huntington Station; John Robert Ryan, Wantagh, both of N.Y.

[73] Assignee: East/West Industries, Inc., Farmingdale, N.Y.

[22] Filed: Dec. 4, 1975

[21] Appl. No.: 637,730

[52] U.S. Cl. ..... 116/20; 116/124 B; 350/98

[51] Int. Cl.[2] ..... G08B 5/00

[58] Field of Search ..... 116/20, 124 B, 124 R; 350/98

[56] References Cited

UNITED STATES PATENTS

| | | | |
|---|---|---|---|
| 2,504,982 | 4/1950 | Hunter | 116/20 |
| 2,698,595 | 1/1955 | Morgan | 116/20 |
| 2,698,596 | 1/1955 | Morgan | 116/20 |
| 2,862,531 | 12/1958 | Walker | 116/124 B |
| 3,164,124 | 1/1965 | Ehrsam | 116/20 |

OTHER PUBLICATIONS

Heligraphic Signaling Mirrors, by R. S. Hunter; Feb. 1946, pp. 110, 111, 112 of Journal of the Optical Society of America, vol. 36, No. 2.

*Primary Examiner*—S. Clement Swisher
*Assistant Examiner*—Denis E. Corr

[57] ABSTRACT

This invention is for a portable signaling device which provides the user with the ability to accurately position the device in a manner to be assured that the reflections from the mirror-like surface forming a part of the signaling device are directed at the target. The signaling device includes signaling means having a plate with a surface to reflect the rays of the sun and sighting means maintained in spaced relation to the signaling means. An aperture is provided on the signaling means and the sighting means through which the user can view the target to obtain proper alignment and in turn maximum reflection from the mirror-like surface to the target. In addition, the reflective surface of the signaling means includes a set of cross hairs which are adapted to be reflected onto the sighting means such that the reflective set of cross hairs can be maintained in alignment with the aperture on the sighting means to maintain a proper alignment therebetween for maximum transmission of the signal to the target.

30 Claims, 4 Drawing Figures

FIG. 2
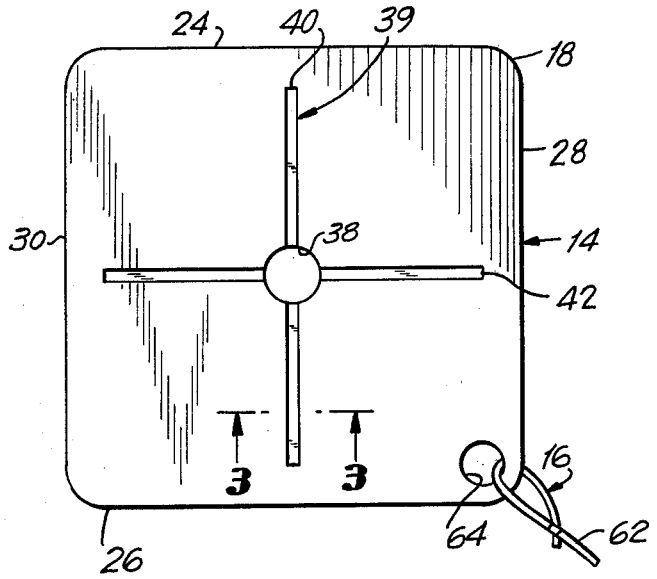
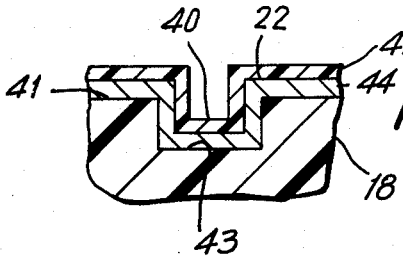
FIG. 3
FIG. 4
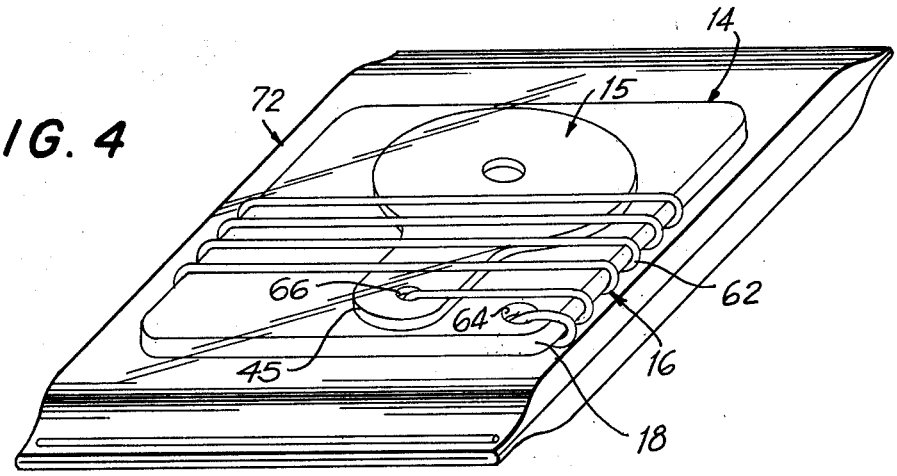

SIGNALING DEVICE

BACKGROUND OF THE INVENTION

The invention relates generally to signaling devices or implements and more particularly to a signaling device which reflects the rays of the sun to signal a message to a target or object, which signal is to be read by an individual generally at or on the target.

The signaling device of the present invention permits the user to be assured that the reflections from a reflective surface or mirror are being properly directed or aimed to the recipient of the message. The mere utilization of a mirror for signaling does not guarantee that the reflective band of light is being properly directed to the individual who has to read and decode same. In normal practice the receiver of the message is at a great distance from the individual sending the message, such that the sender is not totally sure that he is transmitting the signal to the target such that the receiver can properly receive and interpret same.

To overcome the prior art problems, applicants have invented a signaling device that substantially increases the accuracy of the transmitted signal to be assured that it is being properly received. To accomplish this task the present invention makes use of the fact that if two points in spaced relationship with each other are brought into alignment with a third point, which in the present case is the target, that a proper aiming of the signal would be accomplished. Applicants have now discovered that it is possible in a simplified manner to incorporate this known visual concept into a signaling device to be assured of its functioning with maximum accuracy.

OBJECTS OF THE INVENTION

An object of the present invention is to provide an improved signaling device which is easily and quickly opened for use.

Another object of the present invention is to provide an improved signaling device easily storable in a survival kit.

Another object of the present invention is to provide a signaling device which includes means for sighting the target to obtain maximum readability of the signal transmitted.

Another object of the present invention is to provide a signaling device which is shatterproof, fracture resistant, highly reflective, lightweight, non-distorting, and capable of long term storage and stable under various environments.

Other objects of the present invention will become apparent as the disclosure proceeds.

SUMMARY OF THE INVENTION

The invention is for a signaling device which provides the user of the device with a fool proof means of properly sighting the target to which the signal is being transmitted. The term "target" used herein is defined to be any sort of airplane, ship, vehicle, or an individual either contained therein or stationed elsewhere, who is receiving the signal being transmitted by the user of the implement.

The device includes signaling means in the form of a plate adapted to be held in the hand of the user, having a highly reflective surface on one side of the plate with an aperture extending through the plate at substantially the center thereof. Alignment means in the form of a horizontal line and a vertical line is provided on the reflective surface at substantially right angles to each other with the aperture extending through the point at which the lines intersect. These cross or grid lines act as alignment means in that the user can control the signaling means by initially holding the signaling means to be located in a specific location on the sighting means relative to reflective alignment means.

The signaling device further includes sighting means which includes a plate of a size adapted to be held in the hand of the user and positioned in spaced relation to the signaling means and between the signaling means and the target. The sighting means includes an aperture substantially located in the center thereof, which aperture is positioned in aligned relationship with the aperture in the signaling means by the user such that the eye of the user looks through the signaling aperture and sighting aperture to align the target in a manner similar to sighting a target when using a rifle or a scope. To further aid the user, the signaling means on the surface facing the reflective surface is dulled in a manner to cast a shadow of the cross-hairs at the center of the sighting aperture. In use the cross hairs on the reflective surface will cast a shadow and be brought into centered alignment with the sighting aperture by utilization of the reflective alignment means to further guarantee proper alignment of the signaling means with the target to be assured that a maximum amount of the signal is properly reflected to the target and not in some other direction.

To assist the user in operation of the device, coupling means is provided to maintain the signaling means and the sighting means in spaced relation to each other and at the same time may be sufficiently flexible so that the signaling means and sighting means may be stored in overlapping relationship to each other with the coupling means entwined therearound and thereafter placed in the package so that a kit is formed that is easily storable and quickly brought into use when required.

The signaling mirror may be made of a plastic material which is lightweight and shatterproof and having a highly reflective mirror-like surface that may be chrome plated on one side thereof containing a coating thereon to protect the surface and making it easily capable of long-term storage and stable under all environments. The sighting means can also be manufactured from a plastic material that has a dull finish to reflect the cross hairs. In this manner a two-piece arrangement of the sighting means and the signaling means may be the same weight as one piece of stainless steel for the mirror and less than fifty percent of the weight of one piece of glass for a signaling mirror alone.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

FIG. 2 is a front view of the signaling means showing the reflective surface and cross hairs thereon;

FIG. 3 is an enlarged partial sectional view of the signaling means taken in the direction of arrows 3—3 in FIG. 2;

FIG. 4 is a perspective view of a kit embodying the components of the signaling device in a manner for storage thereof.

PREFERRED EMBODIMENT OF THE INVENTION

Figure 1:
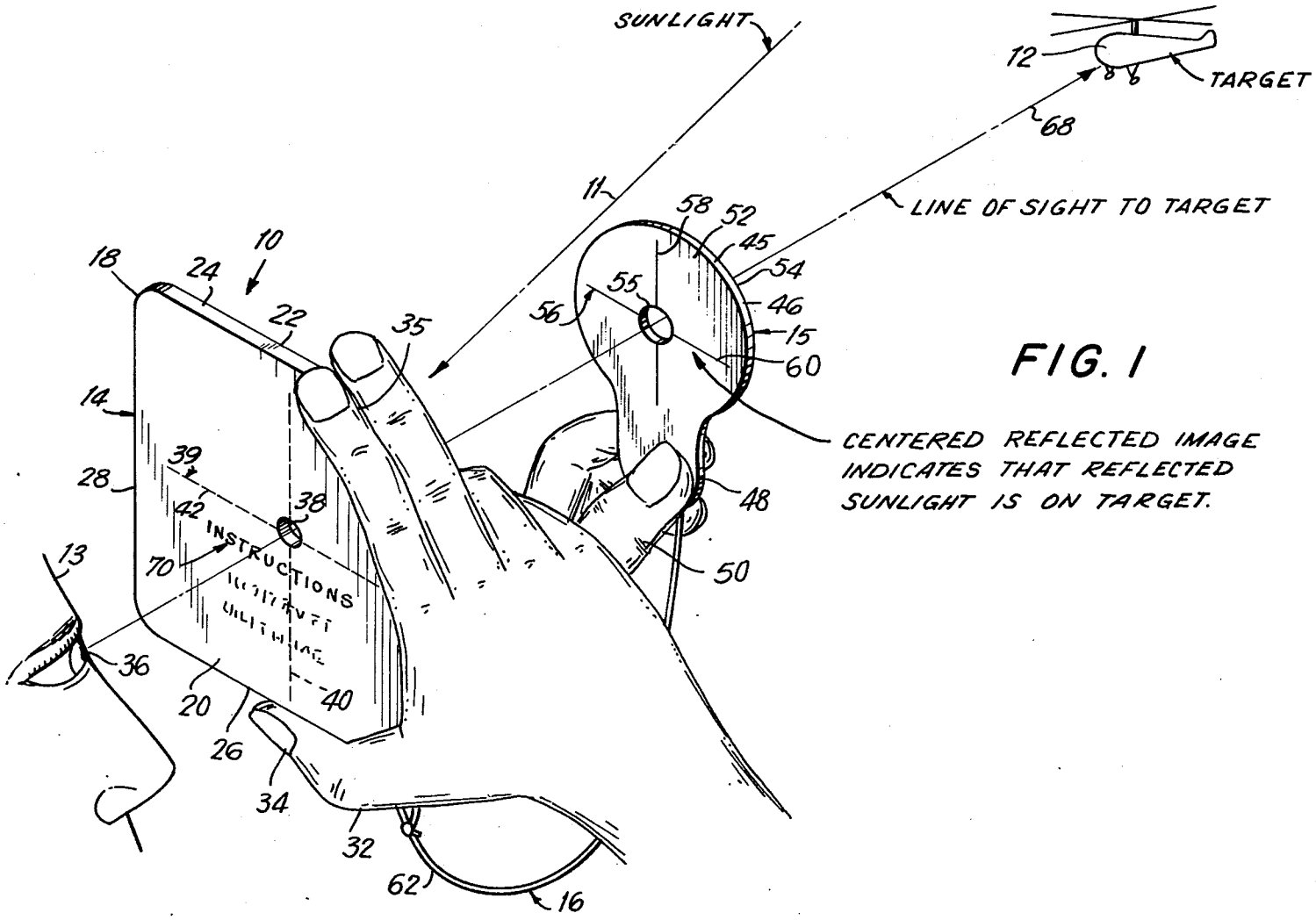
FIG. 1 is a diagramatic view of the signaling device in use.

In accordance with the invention and as illustrated particularly in FIG. 1, there is shown a portable signaling device 10 that uses sunlight indicated by arrow 11 as the energy source for transmitting a signal to a target 12 by a user 13. The signaling device 10 consists of signaling means 14, sighting means 15, and connecting means 16 adapted for use in conjunction with each other in a manner hereinafter described in detail.

The signaling means 14 includes a plate 18 having a rear surface 20 and a front planar reflective surface means 22 which acts as a mirror-like surface to reflect the rays of sunlight illustrated by arrow 11. The plate has an upper end 24, a lower end 26, and spaced apart side ends 28 and 30. As is seen in FIG. 1 the signaling means 14 is held by the user 13 in such a manner that his right hand 32 (or left hand) has his thumb 34 in engagement with the lower end 26 of the signaling means 14 and the index and/or middle fingers indicated by the reference numeral 35 engaging the upper end 24 of the signaling means 14 in such a manner that the eye 36 of the user can look through an aperture 38 contained substantially at the center of the plate 18. The size of the aperture 38 may be in the range of ⅛ inch to ½ inch in diameter, although other cross-sectional shapes may be selected, the aperture 38 is preferably of a diameter of approximately 3/16 of an inch. The signaling means 14 is of a size easily adapted to be held by the hand of the user and the dimensions of 2 inches wide between ends 28 and 30 and 3 inches high between ends 24 and 26 have been found ideally suited for the intended use of the signaling device 10.

The signaling means 14 further includes on the reflective surface 22 alignment or cross-hair means 39 which may include a vertical line 40 and a horizontal line 42 that are substantially perpendicular to each other and the intersection of the vertical line 40 and the horizontal line 42 effectively occurs at the center of the aperture 38. These vertical and horizontal lines act as cross hairs and aid sighting the target 12 and establishing maximum transmission of the reflected beam of light to the target 12. The cross hairs 40 and 42 are formed on the surface 22 of plate 18 in a manner to be non-reflective of the sunlight rays 11 so as to in effect cast a corresponding cross-hair shadow on the sighting means 15 held a short distance from the signaling means 14 as illustrated in FIG. 1. The cross hairs 40 and 42 may be formed for example by grooves as illustrated in FIGS. 2 and 3, or by taping to the reflective surface 22 a non-reflective tape. The surface 41 of the plate 18 may have a groove or channel 43 extending therein across the full width thereof or substantially thereacross as illustrated in FIG. 3. The reflective surface 22 is formed as by a chrome plating 44 which extends across the surface 41 and within the channels 43 as seen in FIG. 3. The width and depth of the grooves 43 are selected to act as a canyon which captures the sunlight 11 and becomes non-reflective on the sighting means 15. The reflective surface means 22 may have a protective coating 47 thereon that is transparent.

The sighting means 15 used in conjunction with the signaling means 14 includes a plate 45 having an upper enlarged end 46 and a lower end 48 that is adapted to be held by the left hand 50 (or right hand) of the user 13. The plate 45 includes a front surface 52 and a rear surface 54 with the front surface 52 being maintained in spaced relationship to the reflective surface 22 of the plate 18. The plate 45 may have a black non-reflective finish for ease of aiming. An aiming aperture 55 is provided that may be centrally located in the upper portion 46 of the plate 45 and extends between the front surface 52 and rear surface 54. The aperture 55 may be of a circular configuration as illustrated, of a diameter in the range of ⅛ inch to ½ inch and preferably of a diameter of approximately 3/16 of an inch.

When the signaling means 14 is used properly the sighting means 15 will have positioned thereon lines that will be superimposed onto reflected alignment or cross-hair means 56 consisting of a vertical line 58 and a horizontal line 60. Accordingly, lines 58 and 60 are to have superimposed thereon lines or shadows reflective of vertical line 40 and horizontal line 42 respectively. The intersection of the reflected vertical line 58 and the horizontal line 60 should ideally occur at the center of the aperture 55. Accordingly, alignment means 39 on the surface 22 are reflected by the cross-hairs 40 and 42 onto surface 52 to form reflected cross-hairs that overlap lines 58 and 60, respectively, on the surface 52. The present invention contemplates that the alignement means 39 may be positioned elsewhere on the reflective surface 22 and one or more grids or pairs of grids of various shapes may be used. In this manner the grids or lines may have various shapes selected to provide the user with the necessary alignment.

The signaling device 10 further includes connecting means 16 which may include a flexible line or lanyard 62 which may be made of nylon or other material that is connected at one end to the signaling means 14 as by extending through a hole 64 (FIG. 2) in the signaling plate 18 and in a similar manner extending through a hole 66 (FIG. 4) in the plate 45 or in some other manner permanently joined to the signaling means 14 and the sighting means 15. The length of the connecting means may be in the range of 6 to 18 inches in length and a length of 12 inches has been found most satisfactory. Although a flexible connecting means 16 is illustrated a rigid type could be utilized permitting an easy swival of the signaling means 14 relative to the connecting means 16.

Indicia means 70 is provided on rear surface 20 to provide the user with instructions for use of the implement 10. This avoids the possibility of misplacing the instructions when the implement 10 is being used.

In actual operation the signaling means 14 is held by the user in such a manner that the mirror-like reflective surface 22 is adapted to reflect the rays of the sun indicated by arrow 11 with the reflective beam or signals in turn transmitted to the target 12 by the user 13. As indicated before, although the target 12 is illustrated as an aircraft, it is understood that it may be a variety of vehicles or merely one individual signaling to another individual from land to sea, sea to land, sea to air, land to land, etc.

The signaling means 14 is positioned such that the eye 36 of the user 13 is held in angular positionment that he is capable of seeing through the aperture 38 and viewing the target 12. The signalng means is held with the reflective surface 22 away from the face of the user 13. The sighting means 15 is then positioned such that the aperture 55 is brought into axial alignment with the target 12 and simultaneously aligned with the aperture 38 of the plate 18 so that the target is viewed along the arrow 68. At this point in time the user 13 has now properly positioned the signaling means 14 and sighting means 15 such that the sunlight indicated by arrow 11 will be reflected from the surface 22 in the direction of the target 12.

Furthermore, the alignment means 39 has to be reflected on the front surface 52 of the sighting means 15 to be assured that the reflected beams of light are visible by the observer on the target and that they are not being transmitted in a direction preventing a proper reading of the transmitted signal. Towards this end the cross hairs 40 and 42 on the surface 22 are ideally aligned such that the reflected cross hairs 58 and 60 on the surface 52 of plate 45 intersect at the imaginary center of aperture 55. The alignment of the reflected image or shadow on cross hairs 58 and 60 aids in centering the reflected sunlight through the hole 55 and around the sighting means 15 in the direction of the target 12. The signaling means 14 is then rotated by the user 13 in the conventional manner as required to reflect the sunlight through the sighting plate aperture 55 and around the sighting means 15 at the target 12 while simultaneously maintaining the reflected alignment means 56 centrally located with respect to aperture 55.

Accordingly, the alignment means 39 has a vertical line 40 and horizontal line 42 that may vary as to width, height, or even direction. If desired the lines 40 and 42 may vary in their angular relationship to the aperture 38, the important thing is that they perform the function of casting a shadow on the surface 52 of plate 45.

As seen in FIG. 4, the signaling device 10 is shown stored in a container 72 which may be of plastic or some other material such that the signaling means 14 and sighting means 15 are in overlapping relationship to each other and the connecting means 16 wound therearound so that the kit is formed and may be easily stored for use from time to time.

Although an illustrative embodiment of the invention has been described in detail herein with reference to the accompanying drawing, it is to be understood that the invention is not limited to that precise embodiment, and that various changes and modifications may be effected therein without departing from the scope or spirit of the invention, except in the appended claims.

I claim:

1. A signaling device for use by a user to signal a target with reflective sunlight, comprising:

A. sighting means for positionment between the user and target including:
   1. a sighting plate, and
   2. a sighting aperture extending through said plate to view the target, B. signaling means for positionment between said sighting means and the user including:
   1. a signaling plate,
   2. a reflective substantially planar surface on one side of said plate positioned facing the target to reflect the sunlight thereto,
   3. a signaling aperture extending through said plate to view the target, said sighting aperture and said signaling aperture are maintained in alignment such that the user can view the target and direct the reflections from the reflective surface to the target, and
   4. alignment means comprising lines on said reflective surface adapted to provide a shadow on said sighting means such that when said sighting means aperture and said signaling means aperture are aligned by the user with the target the alignment means is positioned to coincide with the center of said sighting aperture and the reflected shadow from said lines on said signaling plate permits continuous monitoring to provide proper alignment such that maximum transmission of light from said reflective surface to the target in response to the movement of said signaling means is obtained, C. reflected alignment means on said sighting means comprising matching lines contained on the surface of said sighting plate facing said signaling means to properly align said shadow on said sighting means with said sighting means aperture to provide said proper alignment, and D. means coupling said signaling means to said sighting means, said coupling means is connected to said signaling means by a flexible member in a manner to permit angular displacement thereof by the user to permit signaling therewith.

2. A signaling device as defined in claim 1, wherein said flexible member is dimensioned to be wrapped around said signaling and sighting means for storage of the signaling device.

3. A signaling device as defined in claim 1, wherein said signaling aperture is of a circular configuration.

4. A signaling device as defined in claim 3, wherein said signaling aperture has a cross-sectional diameter in the range of ⅛ inch to ½ inch.

5. A signaling device as defined in claim 1, wherein said sighting aperture is of a circular configuration.

6. A signaling device as defined in claim 5, wherein said sighting aperture has a cross-sectional diameter in the range of ⅛ inch to ½ inch.

7. A signaling device as defined in claim 1, wherein said signaling plate is a plastic material.

8. A signaling device as defined in claim 1, wherein said sighting plate is a plastic material.

9. A signaling device as defined in claim 1, and further including a non-reflective coating on the surface of said sighting plate containing said lines.

10. A signaling device as defined in claim 1, wherein said coupling means has a length in the range of approximately 6 inches to 18 inches.

11. A signaling device as defined in claim 10, wherein said coupling means is approximately 12 inches in length.

12. A signaling device as defined in claim 1, wherein said signaling means further includes a protective coating on said reflective surface.

13. A signaling device as defined in claim 1, wherein said sighting means includes an enlarged upper section and a smaller lower section for gripping same.

14. A signaling device as defined in claim 1, wherein said reflective surface is chrome plated.

15. A signaling device as defined in claim 1, wherein said lines on said alignment means and said reflected alignment means each include a horizontal line and a vertical line such that the image to be reflected by said lines on said signaling means is superimposed on said lines on said sighting means.

16. A signaling device as defined in claim 15, wherein said horizontal line and said vertical line intersect through said signaling aperture.

17. A signaling device as defined in claim 1, and further including indicia means provided on said signaling means to provide the user with instructions for operation of the signaling device.

18. A signaling device for use by a user to signal a target with reflective sunlight, comprising:

A. sighting means for positionment between the user and target including:
1. a sighting plate including an enlarged upper section and a smaller lower section for gripping same,
2. a non-reflecting coating on said sighting plate,
3. a sighting aperture having a cross-sectional diameter in the range of ⅛ inch to ½ inch extending through said plate to view the target, B. signaling means for positionment between said sighting means and the user including:
1. a signaling plate,
2. a reflective planar surface on one side of said plate positioned facing the target to reflect the sunlight thereto,
3. signaling aperture having a cross-sectional diameter in the range of ⅛ inch to ½ inch extending through said signaling plate to view the target, said sighting aperture and said signaling aperture are maintained in alignment such that the user can direct the reflections from the reflective surface to the target, and
4. alignment means on said reflective surface including a substantially horizontal line and a substantially vertical line that intersect through said signaling aperture so as to provide a shadow on said sighting means such that when said sighting aperture and said signaling aperture are aligned by the user with the target the horizontal and vertical lines are positioned to coincide with the center of said sighting aperture and the reflected shadow on said sighting plate permits continuous monitoring to provide proper alignment such that maximum transmission of the signals to the target is obtained, C. reflected alignment means on said sighting means contained on the surface of said sighting plate facing said signaling means to properly align said shadow on said sighting means with said sighting aperture to provide said proper alignment, said reflected alignment means comprising a substantially horizontal line and a substantially vertical line that intersect through said sighting aperture, so as to reflect said shadow from said lines of said alignment means in superimposed relationship on said lines of said reflected alignment means such that the maximum amount of the signal is transmitted to the target, D. flexible means coupling said signaling means to said sighting means to permit angular displacement by the user of said signaling means to permit signaling therewith, said coupling means dimensioned to be wrapped around said signaling means and said sighting means for storage of the signaling device, and E. indicia means provided on said signaling means to provide the user with instructions for operation of the signaling device.

19. A signaling device as defined in claim 18, wherein said signaling plate is a plastic material.

20. A signaling device as defined in claim 18, wherein said sighting plate is a plastic material.

21. A signaling device as defined in claim 18, wherein said coupling means has a length in the range of 6 inches to 18 inches.

22. A signaling device as defined in claim 21, wherein said coupling means is approximately 12 inches in length.

23. A signaling device as defined in claim 18, wherein said signaling means further includes a protective coating on said reflective surface.

24. A signaling device as defined in claim 18, wherein said reflective surface is chrome plated on said signaling plate.

25. A signaling device as defined in claim 18, wherein said sighting means and said signaling means are adapted to be placed in overlapping relationship to each other with said flexible means wrapped therearound and stored in a container.

26. A kit adapted to be easily assembled into a signaling device for signaling messages to a target by a user with reflective sunlight, comprising:

A. container means,

B. sighting means including a sighting plate having a sighting aperture to view the target, C. signaling means including a signaling plate having a reflective surface with a signaling aperture to view the target and positioned in overlapping relation to said sighting means within said container, D. alignment means comprising lines on said reflective surface including a substantially horizontal line and a substantially vertical line that intersect through said signaling aperture so as to provide a shadow on said sighting means such that when said sighting aperture and said signaling aperture are aligned by the user with the target the horizontal and vertical lines are positioned to coincide with the center of said sighting aperture and the reflected shadow from said lines on said sighting means permits continuous monitoring to provide proper alignment such that maximum transmission of the signals to the target is obtained, E. reflected alignment means on said sighting means comprising matching lines contained on the surface of said sighting plate facing said signaling means to properly align said shadow on said sighting means with said sighting means aperture to provide said proper alignment, F. flexible means coupling said signaling means to said sighting means, said coupling means wrapped around said signaling means and said sighting means during storage in said container means, and G. said kit assembled into operational use by positioning said sighting means between the user and target, said signaling means between the user and said sighting means with the reflective surface facing the target with said signaling aperture and said sighting aperture in axial alignment with the target and said shadow of said lines on said signaling means being reflected in superimposed relationship on said lines of said reflected alignment means, and said flexible means coupling said sighting means to said signaling means.

27. A kit as defined in claim 26, wherein said coupling means has a length in the range of approximately 6 inches to 18 inches.

28. A kit as defined in claim 27, wherein said connecting means is approximately 12 inches in length.

29. A kit as defined in claim 26, and further including indicia means provided on said signaling means to provide the user with instructions for operation of the kit.

30. A kit as defined in claim 26, wherein said coupling means is connected to said signaling means in a manner to permit angular displacement thereof by the user to permit signaling therewith.

* * * * *